United States Patent [19]

Camarda

[11] 4,014,079

[45] Mar. 29, 1977

[54] BRACELET TYPE FASTENING DEVICE

[75] Inventor: Joseph Camarda, Garden City Park, N.Y.

[73] Assignee: Les Bernard, Inc., New York, N.Y.

[22] Filed: June 10, 1975

[21] Appl. No.: 585,526

[52] U.S. Cl. ..... 24/201 HE; 63/4; 24/201 BN

[51] Int. Cl.[2] ..... A44B 17/00

[58] Field of Search ..... 24/201 BM; 59/80; 63/4 X; 198/189; 59/78.1, 90

[56] References Cited

UNITED STATES PATENTS

| | | | |
|---|---|---|---|
| 1,144,411 | 6/1915 | Hamachek | 98/189 |
| 1,631,296 | 6/1927 | Smith | 59/80 |
| 2,303,294 | 11/1942 | Wagner | 59/80 |
| 2,539,891 | 1/1951 | Carr et al. | 59/80 |

FOREIGN PATENTS OR APPLICATIONS

| | | | |
|---|---|---|---|
| 920,737 | 1/1947 | France | 24/201 BN |

*Primary Examiner*—Werner H. Schroeder
*Assistant Examiner*—Doris L. Troutman
*Attorney, Agent, or Firm*—Daniel Jay Tick

[57] ABSTRACT

A bracelet type fastening device for releasably affixing the ends of a bracelet type item to each other to secure the item on a part of the body of a wearer comprises a first fastening member pivotally affixed to a first end of a bracelet type item and having a semicircular support part of predetermined diameter and a catch pin affixed to the support part and extending diametrically thereacross. A second fastening member is pivotally affixed to a second end of the bracelet type item and has a spherical hook member having a diameter smaller than the predetermined diameter and a slot formed radially therein for accommodating the pin of the first fastening member. The slot extends in a plane inclined at a predetermined angle with a central plane of the second fastening member and opens toward the item. The second fastening member on the part of the body of a wearer is pivotable relative to the item to an insertion and removal position in which the hook member is movable into and out of the support part of the first fastening member with the pin of the first fastening member being simultaneously moved into and out of the slot of the hook member. The second fastening member is further pivotable relative to the item to a secure position in which the item is normally worn on the part of the body of the wearer and in which the portion of the hook member between the plane perpendicular to the central plane of the second fastening member and the plane of the slot prevents the removal of the hook member from the pin thereby securing the item around the part of the body of the wearer.

5 Claims, 6 Drawing Figures

BRACELET TYPE FASTENING DEVICE

BACKGROUND OF THE INVENTION:

The present invention relates to a bracelet type fastening device. More particularly, the invention relates to a bracelet type fastening device for releasably affixing the ends of a bracelet type item to each other to secure the item on a limb or around the neck of a wearer.

Bracelet type items worn by people on their limbs or around their necks have a tendency to unfasten themselves and become lost. This occurs most often, during some type of physical activity of the wearer, so that he or she is moving his or her arms and legs, to which such device may be affixed. The wearer is thus not aware of the loss of the item until he or she is at another place at another time. It is then difficult, if not impossible, to retrieve the lost item, such as, for example, a bracelet of any type, including jewelry, costume jewelry, identification item, a necklace of any type, or the like.

The principal object of the invention is to provide a bracelet type fastening device for securing an item on a limb such as, for example, an arm or a leg, or around the neck of a wearer in a manner whereby the item will not become unfastened at any time unless the wearer willfully removes it.

An object of the invention is to provide a bracelet type fastening device of simple structure, which is inexpensive in manufacture and is used by anyone with facility and convenience to secure an item on a limb or around the neck and to remove such item from the limb or from the neck.

Another object of the invention is to provide a bracelet type fastening device for releasably affixing the ends of a bracelet type item to each other, which fastening device can not become undone while it is worn on a limb or around the neck without specific manipulation thereof.

Still another object of the invention is to provide a bracelet type fastening device which functions effectively, efficiently and reliably to secure a bracelet type item to a limb such as, for example, a wrist or an ankle, or around the neck, of a wearer, without danger of accidental loss.

BRIEF SUMMARY OF THE INVENTION:

In accordance with the invention, a bracelet type device for releasably affixing the ends of a bracelet type item to each other to secure the item around part of the body such as on a limb or around the neck of a wearer has first and second opposite ends and comprises a first fastening member pivotally affixed to the first end of a bracelet type item and having a substantially semicircular support part of a predetermined diameter. A catch pin is affixed to the support part and extends substantially diametrically thereacross. The first fastening member has a central plane therethrough and an axis in the plane. The pin is in the central plane.

A second fastening member is pivotally affixed to the second end of the bracelet type item and has a substantially spherical hook member. The hook member has a diameter smaller than the predetermined diameter and a slot formed substantially radially therein for accommodating the pin of the first fastening member. The second fastening member has a central plane therethrough and an axis in the plane. The slot extends in a plane inclined at a predetermined angle with the central plane and opens toward the item. The second fastening member on the part of the body of a wearer is pivotable relative to the item to an insertion and removal position in which the plane of the slot of the second fastening member is substantially perpendicular to the central plane of the first fastening member whereby the hook member is movable into and out of the support part of the first fastening member with the pin of the first fastening member being simultaneously moved into and out of the slot of the hook member. The second fastening member is further provided relative to the item to a secure position in which the item is normally worn on the part of the body of the wearer and in which the central planes of the first and second fastening members are substantially coplanar and the slot of the second fastening member extends at the predetermined angle with the central plane of the first fastening member whereby the portion of the hook member between the plane perpendicular to the central plane of the second fastening member and the plane of the slot prevents the removal of the hook member from the pin thereby securing the item around the part of the body of the wearer.

The first fastening member has a length and spaced opposite length ends, an inner surface adjacent the part of the body of the wearer and an outer surface spaced from and substantially parallel to the inner surface. The central plane is equidistant between the inner and outer surfaces and extends through the length ends.

The second fastening member has a length and spaced opposite length ends, an inner surface adjacent the part of the body of the wearer and an outer surface spaced from and substantially parallel to the inner surface. The central plane is equidistant between the inner and outer surfaces and extends through the length ends and the center of the hook member.

The predetermined angle is approximately 45°.

The bracelet type item is preferably a wrist bracelet.

BRIEF DESCRIPTION OF THE DRAWING:

In order that the invention may be readily carried into effect, it will now be described with reference to the accompanying drawing, wherein.

In the FIGS., the same components are identified by the same reference numerals.

DETAILED DESCRIPTION OF THE INVENTION:

The bracelet type fastening device of the invention is for releasably affixing the ends of a bracelet type item such as, for example, a bracelet of any type, including bracelet of jewelry, costume jewelry, an identification bracelet and the like, to each other to secure the item around or on part of the body, such as on a limb or around the neck of a wearer. For the purpose of illustration, a bracelet 1 is shown in FIGS. 1 to 4 and 6 and is secured to a limb such as, for example, a wrist 2, of a wearer in FIGS. 4 and 5. The bracelet 1 is shown in position prior to securing the ends thereof on the wrist 2 in FIG. 3. The bracelet 1 has a first end 3 (FIGS. 1 to 4 and 6) and a second, opposite, end 4 (FIGS. 1 to 4).

Figure 1:
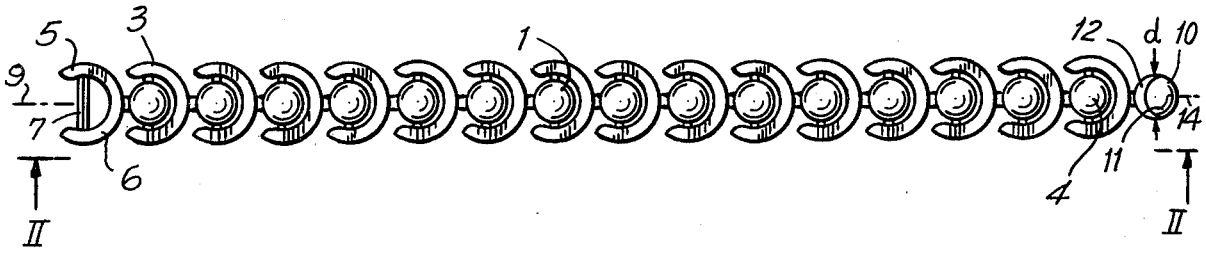
FIG. 1 is a view of an embodiment of the bracelet type fastening device of the invention affixed to a bracelet.

The bracelet type fastening device of the invention comprises a first fastening member 5 pivotally affixed to the first end 3 of the bracelet 1. The first fastening member 5 has a substantially semicircular support part 6 of predetermined diameter D (FIGS. 5 and 6) and a catch pin 7 (FIGS. 1 and 3 to 6). The catch pin 7 is affixed to the support part 6 and extends substantially diametrically thereacross. The first fastening member 5 has a central plane 8 therethrough (FIGS. 2 and 3) and an axis 9 in said plane (FIG. 1). The pin 7 is in the central plane 8.

A second fastening member 10 is pivotally affixed to the second end 4 of the bracelet 1. The second fastening member 10 has a substantially spherical hook member 11 having a diameter *d* (FIG. 1) smaller than the predetermined diameter D of the support part 6 of the first fastening member 5. A slot 12 (FIGS. 2 to 6) is formed substantially radially in the hook member 11 for accommodating the pin 7 of the first fastening member 5.

The second fastening member 10 has a central plane 13 therethrough (FIGS. 2 and 3) and an axis 14 (FIG. 1) in said plane. The slot 12 extends in a plane inclined at a predetermined angle A with the central plane 13 and opens toward the bracelet 1, as shown in FIG. 3.

Figure 3:
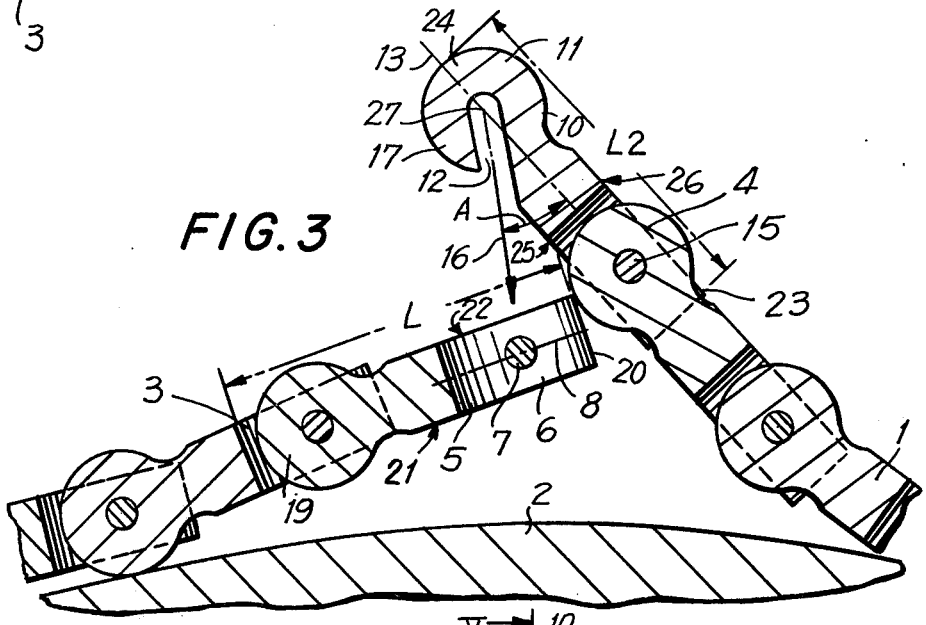
FIG. 3 is a view, on an enlarged scale, partly cutaway and partly in section, of the embodiment of FIG. 1 in position for fastening the ends of the bracelet to each other.

The second fastening member 10 on the limb or wrist of the wearer is pivotable about a pivot pin 15 of the bracelet (FIGS. 3 and 4), to an insertion and removal position shown in FIG. 3, in which the plane 16 of the slot 12 of the second fastening member is substantially perpendicular to the central plane 8 of the first fastening member 5. In such position, the hook member 11 is movable into and out of the support part 6 of the first fastening member 5 with the pin 7 of said first fastening member being simultaneously moved into and out of the slot 12 of said hook member.

Figure 4:
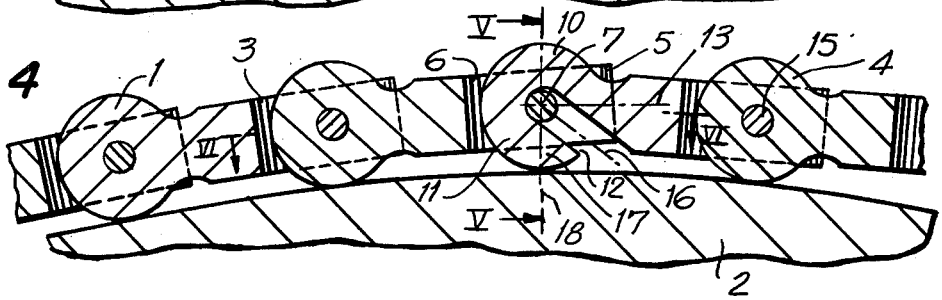
FIG. 4 is a view, on an enlarged scale, partly cutaway and partly in section, of the embodiment of FIG. 1 in securing position.
Figure 5:
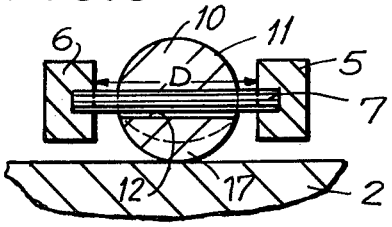
FIG. 5 is a sectional view, taken along the lines V—V of FIG. 4.
Figure 6:
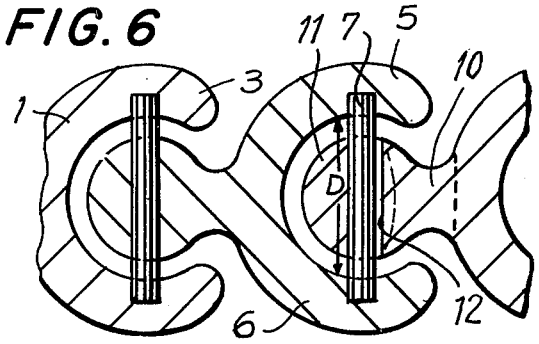
FIG. 6 is a sectional view, taken along the lines VI—VI, of FIG. 4.

The second fastening member 10 is further pivotable relative to the bracelet, about the pivot pin 15 of said bracelet, to a secure position, shown in FIGS. 4, 5 and 6, in which the bracelet is normally worn on the limb or wrist 2 of the wearer. In the secure position, the central planes 8 and 13 of the first and second fastening members 5 and 10, respectively, are substantially coplanar, as shown in FIG. 4. In the secure position, the slot 12 of the second fastening member 10 extends at the predetermined angle A with the central plane 8 of the first fastening member 5 whereby the portion 17 (FIGS. 4 and 5) of the hook member 11 between a plane 18 (FIG. 4) perpendicular to the central plane 13 of the second fastening member 10 and the plane 16 of said slot prevents the removal of the hook member from the pin 7 thereby securing the bracelet around the limb of the wearer.

The first fastening member 5 has a length L1 and spaced opposite length ends 19 and 20, an inner surface 21 adjacent the limb 2 of the wearer and an outer surface 22 spaced from, and substantially parallel to, the inner surface 21, as shown in FIG. 3. The central plane 8 of the first fastening member 5 is equidistant between the inner and outer surfaces 21 and 22 and extends through the length ends 19 and 20.

The second fastening member 10 has a length L2 and spaced opposite length ends 23 and 24, an inner surface 25 adjacent the limb 2 of the wearer and an outer surface 26 spaced from, and substantially parallel to, the inner surface 25, as shown in FIG. 3. The central plane 13 of the second fastening member 10 is equidistant between the inner and outer surfaces 25 and 26 and extends through the length ends 23 and 24 and the center 27 of the hook member 11 (FIG. 3).

Figure 2:
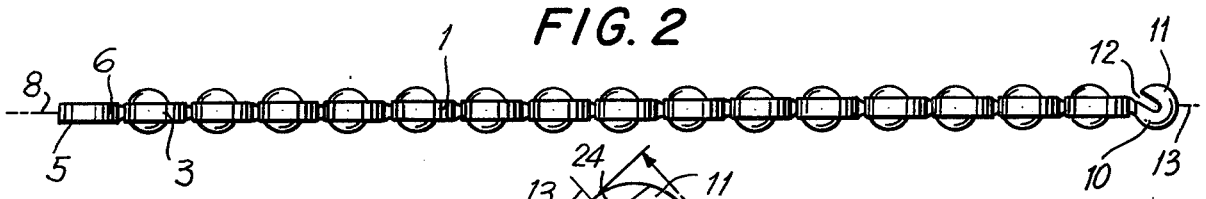
FIG. 2 is a view, taken along the lines II—II, of FIG. 1.

The predetermined angle A of the slot 12 relative to the central plane 13 of the second fastening member 10 is approximately 135° or approximately 45°, depending upon whether the bracelet extends as shown in FIG. 2 with the first end 3 at the left and the second end 4 at the right, or in reverse position, with the second end at the left and the first end at the right.

While the invention has been described by means of a specific example and in a specific embodiment, I do not wish to be limited thereto, for obvious modifications will occur to those skilled in the art without departing from the spirit and scope of the invention.

I claim:

1. A bracelet type fastening device for releasably affixing the ends of a bracelet type item to each other to secure the item around part of the body of a wearer, said bracelet type item having first and second opposite ends, said bracelet type fastening device comprising a first fastening member pivotally affixed to the first end of a bracelet type item and having a substantially semicircular support part of predetermined diameter and a catch pin affixed to the support part and extending substantially diametrically thereacross, said first fastening member having a central plane therethrough and an axis in said plane, said pin being in said central plane; and a second fastening member pivotally affixed to the second end of the bracelet type item and having a substantially spherical hook member having a diameter smaller than the predetermined diameter and a slot formed substantially radially therein for accommodating the pin of the first fastening member, said second fastening member having a central plane therethrough and an axis in said plane, said slot extending in a plane inclined at a predetermined angle of approximately 45° with said central plane and opening toward the item, the second fastening member on the part of the body of a wearer being pivotable relative to the item to an insertion and removal position in which the plane of the slot of the second fastening member is substantially perpendicular to the central plane of the first fastening member whereby the hook member is movable into and out of the support part of the first fastening member with the pin of the first fastening member being simultaneously moved into and out of the slot of the hook member, the second fastening member being further pivotable relative to the item to a secure position in which the item is normally worn on the part of the body of the wearer and in which the central planes of the first and second fastening members are substantially coplanar and the slot of the second fastening member extends at the predetermined angle with the central plane of the first fastening member whereby the portion of the hook member between the plane perpendicular to the central plane of the second fastening member and the plane of the slot prevents the removal of the hook member from the pin thereby securing the item around the part of the body of the wearer.

2. A bracelet type fastening device as claimed in claim 1, wherein the first fastening member has a length and spaced opposite length ends, an inner surface adjacent the part of the body of the wearer and an outer surface spaced from and substantially parallel to the inner surface, and the central plane is equidistant between the inner and outer surfaces and extends through the length ends.

3. A bracelet type fastening device as claimed in claim 1, wherein the second fastening member has a length and spaced opposite length ends, an inner surface adjacent the part of the body of the wearer and an outer surface spaced from and substantially parallel to the inner surface, and the central plane is equidistant between the inner and outer surfaces and extends through the length ends and the center of the hook member.

4. A bracelet type fastening device as claimed in claim 1, wherein the bracelet type item is a wrist bracelet.

5. A bracelet type fastening device as claimed in claim 1, wherein the bracelet type item is a necklace.

* * * * *